US006346880B1

(12) United States Patent
Schroeder et al.

(10) Patent No.: US 6,346,880 B1
(45) Date of Patent: Feb. 12, 2002

(54) CIRCUIT AND METHOD FOR CONTROLLING AN ALARM

(75) Inventors: Stanley J. Schroeder, Gilbert; Leticia Gomez-Torres, Chandler; Juan M. Gutierrez, Phoenix, all of AZ (US); Stanislaw K. Wicka, Los Altos, CA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/468,417

(22) Filed: Dec. 20, 1999

(51) Int. Cl.[7] ..... G08B 29/00
(52) U.S. Cl. ..... 340/506; 340/511; 340/628
(58) Field of Search ..... 340/506, 510, 340/511, 526, 628, 629, 330, 661

(56) References Cited

U.S. PATENT DOCUMENTS

| | | | | |
|---|---|---|---|---|
| 4,101,785 A | | 7/1978 | Malinowski | 250/574 |
| 4,117,479 A | * | 9/1978 | Galvin et al. | 340/506 |
| 4,254,414 A | * | 3/1981 | Street et al. | 340/627 |
| 4,313,110 A | | 1/1982 | Subulak et al. | 340/527 |
| 4,321,592 A | * | 3/1982 | Crandall et al. | 340/541 |
| 4,401,978 A | * | 8/1983 | Solomn | 340/628 |
| 4,792,797 A | | 12/1988 | Tanguay et al. | 340/628 |
| 4,814,748 A | | 3/1989 | Todd | 340/527 |
| RE33,920 E | | 5/1992 | Tanguay et al. | 340/628 |
| 5,422,629 A | | 6/1995 | Minnis | 340/630 |
| 5,708,414 A | * | 1/1998 | Peltier et al. | 340/511 |

* cited by examiner

*Primary Examiner*—Donnie L. Crosland
(74) *Attorney, Agent, or Firm*—Anthony M. Martinez

(57) ABSTRACT

An alarm circuit (10) includes a sensor (11), a comparator (13), a control circuit (16), and a transducer (19). The control circuit (16) controls the transducer (19) and has three modes of operation: standby mode, alarm mode, and silence mode. The comparator (13) compares the voltage of an input signal from the sensor (11) to a first threshold level during the standby mode of operation. The control circuit (16) enables the transducer (19) and transitions to the alarm mode of operation after the voltage of the input signal exceeds the first threshold level. The control circuit (16) disables the transducer (19) for a predetermined time period and transitions to the silence mode of operation after a silence signal is received by the control circuit (16). The input signal is compared to both the first threshold level and a second threshold level during the silence mode. The silence mode can be terminated if the voltage of the input signal falls below the first threshold level or if the voltage of the input signal rises above the second threshold level. In addition, the silence mode can be terminated if the control circuit (16) receives a reset signal or a remote signal from a remote unit.

21 Claims, 2 Drawing Sheets

10

CIRCUIT AND METHOD FOR CONTROLLING AN ALARM

FIELD OF THE INVENTION

The present invention relates, in general to alarms and, more particularly, to circuits for controlling alarms.

BACKGROUND OF THE INVENTION

Conventional smoke detectors provide an audible alarm after the smoke density in an area increases above a predetermined minimum threshold level. Smoke from cooking or persons smoking can cause nuisance or false alarms to occur. Accordingly, many smoke detectors include a silencing feature for temporarily silencing the smoke detector.

Such silencing features can be activated by a push button, thereby disabling the smoke detector for a predetermined time period of, for example, fifteen minutes. During this time period, the smoke condition will usually dissipate, and at the end of the silencing period the detector will return to a normal mode of operation.

Some prior art smoke detectors implement the silencing feature by rendering the smoke detector inoperative. This can be dangerous in the event that a hazardous fire develops after activating the silence feature. Other prior art smoke detectors increase the smoke threshold level necessary for generating an alarm. This is undesirable since it diminishes the smoke sensitivity of the detector during the silence mode of operation. Further, these prior art smoke detectors do not provide a means for canceling the silence mode and remain in the silence mode for a fixed predetermined period.

Accordingly, it would be advantageous to have an alarm circuit that includes a silencing feature for temporarily silencing the alarm circuit. It would be of further advantage for the alarm circuit to remain operative during the silencing period. In addition, it would be advantageous for the alarm circuit to have a feature for canceling the silencing feature before the expiration of the silencing period.

DETAILED DESCRIPTION OF THE DRAWINGS

Figure 1:
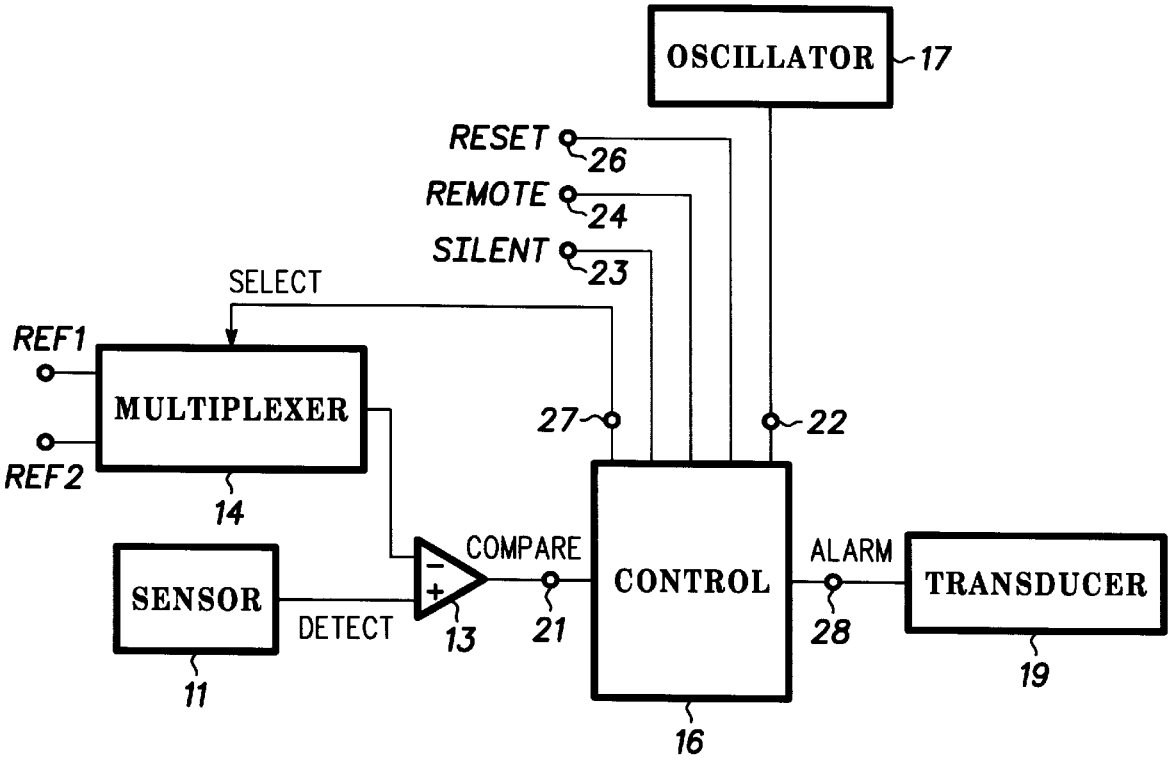
FIG. 1 is a block diagram of an alarm circuit in accordance with an embodiment of the present invention.

FIG. 1 is a block diagram of an alarm circuit 10 in accordance with an embodiment of the present invention. Alarm circuit 10 is suitable for use in the following applications: smoke detectors, heat detectors, vibration detectors, motion detectors, water level detectors, gas leak alarms, tilt alarms, and door alarms.

In embodiment shown in FIG. 1, alarm circuit 10 includes a sensor 11 for providing smoke detection. Sensor 11 generates an input signal labeled DETECT, wherein the magnitude of signal DETECT is proportional to the amount of smoke sensed by sensor 11. By way of example, the voltage of signal DETECT increases as the amount of smoke increases. On the other hand, the voltage of signal DETECT decreases as the amount of smoke decreases.

Sensor 11, also referred to as a sensing element, can be an infrared photoelectric sensor, wherein smoke detection is accomplished by sensing scattered light from smoke particles. Alternatively, sensor 11 can be an ion sensor, wherein the ion sensor includes an ion chamber for monitoring smoke density. Although, sensor 11 is described as a smoke detection sensor, this is not a limitation of the present invention. For example, sensor 11 can also be a microphone for use in a vibration detector. Further, sensor 11 can be an accelerometer, a pressure sensor, or a chemical sensor. The choice of the type of sensor for sensor 11 is a designer's choice based on the application of alarm circuit 10.

Alarm circuit 10 further includes a comparator 13 having a noninverting input terminal coupled for receiving signal DETECT and an inverting input terminal connected to an output terminal of a multiplexer 14.

Multiplexer 14 has a first input terminal coupled for receiving a first reference signal labeled REF1 and a second input terminal coupled for receiving a second reference signal labeled REF2. In addition, multiplexer 14 has a third input terminal coupled for receiving an electrical signal labeled SELECT. Either signal REF1 or signal REF2 is routed to the output terminal of multiplexer 14. In this example, the voltage of signal REF2 is greater than the voltage of signal REF1. Signal SELECT determines which reference input signal (either REF1 or REF2) is transmitted to the output terminal of multiplexer 14. Signal REF1 is transmitted to the output terminal of multiplexer 14 when signal SELECT is at a logic low voltage of, for example, zero volts. On the other hand, signal REF2 is transmitted to the output terminal of multiplexer 14 when signal SELECT is at a logic high voltage of, for example, five volts. A logic high voltage is also referred to as a logic high or a logic one and a logic low voltage is also referred to as a logic low or a logic zero.

Comparator 13 compares an input voltage at its noninverting input terminal to the reference voltage at its inverting input terminal to generate a signal labeled COMPARE at its output terminal. Signal COMPARE at the output terminal of comparator 13 indicates whether the magnitude of signal DETECT is greater than or less than the magnitude of the reference signal received at the inverting input terminal of comparator 13. Signal COMPARE is at logic high voltage when the voltage of signal DETECT exceeds the reference voltage at the inverting input terminal of comparator 13. On the other hand, signal COMPARE is at a logic low voltage when the voltage of signal DETECT is less than the reference voltage at the inverting input terminal of comparator 13.

Alarm circuit 10 further includes a control circuit 16, an oscillator 17, and a transducer 19. Transducer 19 can be a horn for providing an audible alarm or a light for providing a visual alarm. Control circuit 16 has input terminals 21, 22, 23, 24, and 26 and output terminals 27 and 28. Input terminal 21 is connected to the output terminal of comparator 13. Output terminal 27 provides signal SELECT to multiplexer 14. Oscillator 17 has an output terminal for providing an oscillator signal to input terminal 22. Input terminals 23, 24, and 26 are coupled for receiving input signals SILENCE, REMOTE, and RESET. Output terminal 28 is connected to an input terminal of transducer 19.

When enabled, transducer 19 is a device that converts an electrical signal into sound or light. Control circuit 16 provides an electrical signal labeled ALARM at output terminal 28 for enabling transducer 19. Signal ALARM is transmitted from output terminal 28 to the input terminal of transducer 19. Transducer 19 is enabled and provides an alarm when signal ALARM is asserted, i.e., when signal ALARM transitions to a logic high voltage. The alarm can be either an audible alarm or a visual alarm.

Alarm circuit 10 operates in one of following three modes of operation: 1) standby mode, 2) alarm mode, or 3) silence mode. Control circuit 16 processes signals COMPARE, SILENCE, REMOTE, and RESET to determine the mode of operation of alarm circuit 10. Control circuit 16 can be a microprocessor, an Application Specific Integrated Circuit (ASIC), or a Digital Signal Processor (DSP).

Standby mode is the normal mode of operation. Alarm circuit 10 operates in the standby mode of operation when no smoke particles or few smoke particles are detected by sensor 11. Transducer 19 is disabled and remains off so that no alarm is provided. More particularly, during the standby mode of operation, signal SELECT is at a logic low voltage so that signal REF1 is transmitted to the inverting input terminal of comparator 13. Because no smoke particles are detected by sensor 11, the voltage of signal DETECT is less than the voltage of signal REF1. Thus, signal COMPARE is at a logic low voltage indicating that no smoke is detected by sensor 11. Control circuit 16 sets signal ALARM to a logic low voltage, thereby disabling transducer 19.

Alarm circuit 10 transitions to the alarm mode of operation after a predetermined minimum amount of smoke is detected by sensor 11. The voltage of signal REF1 corresponds to this predetermined minimum amount of smoke. As described hereinbefore, as the amount of smoke particles detected by sensor 11 increases, the voltage of signal DETECT increases. If signal DETECT increases to a voltage level greater than the voltage of signal REF1, signal COMPARE transitions from a logic low voltage to a logic high voltage indicating that a predetermined minimum amount of smoke is detected by sensor 11. In response, control circuit 16 enables transducer 19 by setting signal ALARM to a logic high voltage. If the voltage of signal DETECT decreases to a level less than the voltage of signal REF1, then alarm circuit 10 returns to the standby mode of operation. When alarm circuit 10 transitions from the alarm mode to the standby mode, control circuit 16 turns off transducer 19 by transitioning signal ALARM to a logic low voltage.

While in the alarm mode of operation and if signal SILENCE is asserted, i.e., set to logic high voltage, alarm circuit 10 enters the silence mode of operation and temporarily disables transducer 19. In particular, when signal SILENCE transitions from a logic low voltage to a logic high voltage, control circuit 16 pulls down signal ALARM to a logic low voltage for a predetermined time period of, for example, 10 minutes. The silence mode of operation can be cancelled or terminated by one of the following events: 1) the predetermined time period elapses, 2) signal RESET is received by control circuit 16, 3) signal REMOTE is received by control circuit 16, 4) the voltage of signal DETECT exceeds the voltage of signal REF2, or 5) the voltage of signal DETECT decreases to a level below the voltage of signal REF1.

Reference signal REF1 provides a predetermined minimum threshold level for transitioning alarm circuit 10 between the alarm and standby modes of operation. In addition, reference signal REF1 provides a predetermined minimum threshold level for canceling the silence mode of operation. Reference signal REF2 provides a predetermined maximum threshold level for canceling the silence mode of operation.

During the silence mode of operation, control circuit 16 toggles signal SELECT between a logic low voltage and a logic high voltage so that the voltage of signal DETECT is compared to both the voltage of signal REF1 and to the voltage of signal REF2. If the voltage of signal DETECT decreases to a level less than the voltage of signal REF1, then control circuit 16 switches alarm circuit 10 to the standby mode of operation. In standby mode, transducer 19 remains off and signal DETECT is compared to reference signal REF1. If the voltage of signal DETECT increases to a level greater than the voltage of signal REF2, then control circuit 16 transitions alarm circuit 10 to the alarm mode of operation. Transducer 19 is turned on and signal DETECT is compared to reference signal REF1 during the alarm mode of operation.

Control circuit 16 transitions alarm circuit 10 from the silence mode of operation to the alarm mode when signal RESET is received at terminal 26. If signal REMOTE is received by control circuit 16 and is set to a logic high voltage, then the silence mode of operation is terminated.

Alarm circuit 10 can be interconnected with other similar alarm circuits to provide a network of alarms. In a network, a remote alarm unit can transmit signal REMOTE to terminal 24. If signal REMOTE is set to a logic high voltage, then control circuit 16 transitions alarm circuit 10 from the silence mode of operation to the alarm mode to enable transducer 19, thereby canceling the silence mode of operation. When signal REMOTE is received by control circuit 16 and set to a logic high voltage, this indicates that smoke is detected by a remote alarm circuit.

It should be noted that the sensitivity of alarm circuit 10 to smoke remains substantially the same during all modes of operation. That is, the sensitivity of alarm circuit 10 is not diminished or reduced during operation since the predetermined minimum threshold level for generating an alarm is not varied during operation. Specifically, the voltage level of signal REF1 is not varied and signal DETECT is compared to this predetermined minimum threshold level during all three modes of operation.

Figure 2:
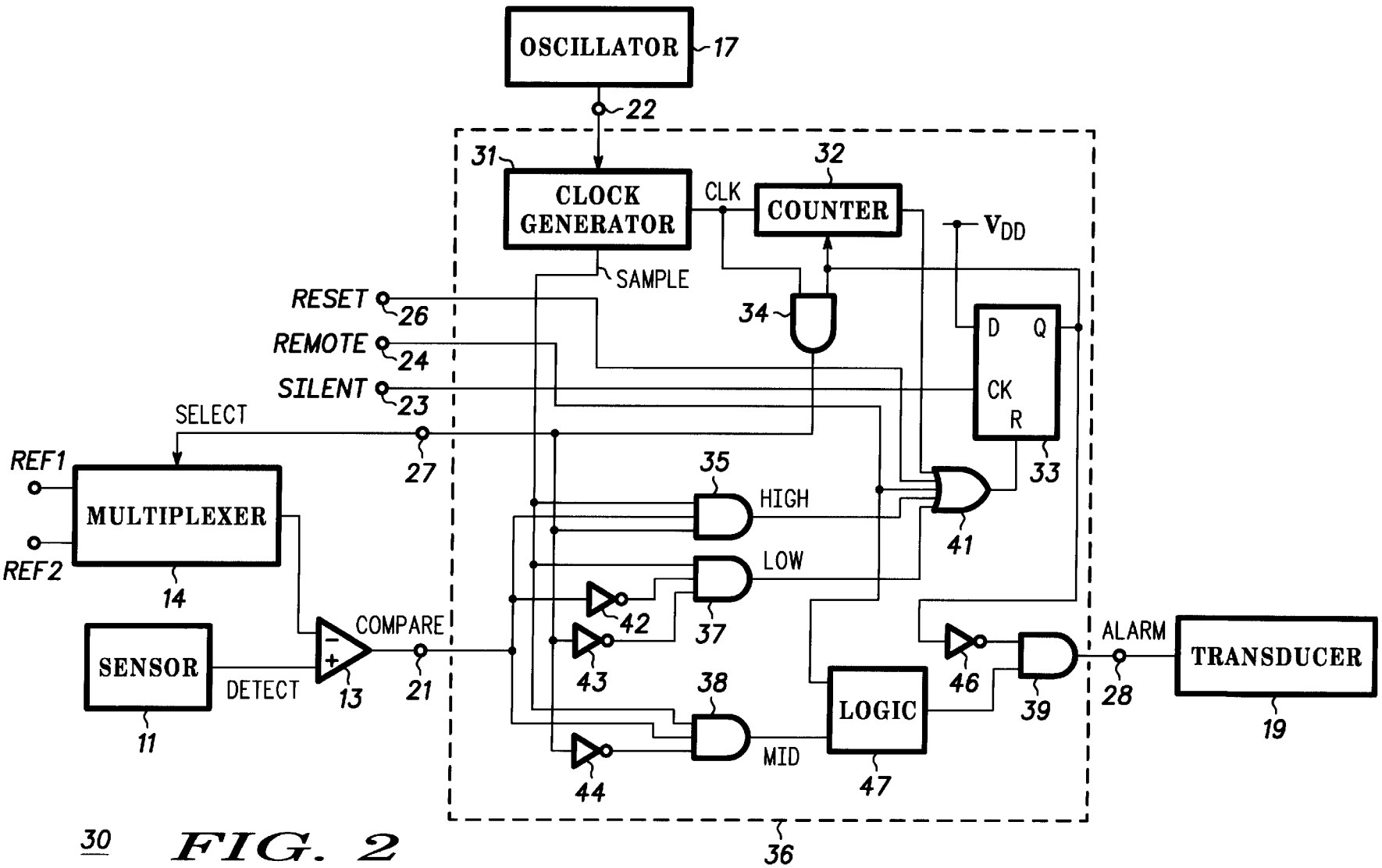
FIG. 2 is a partial block diagram and partial schematic diagram of an alarm circuit in accordance with another embodiment of the present invention.

FIG. 2 is a partial block diagram and partial schematic diagram of an alarm circuit 30 in accordance with another embodiment of the present invention. It should be understood that the same reference numerals are used in the figures to denote the same elements. Similar to alarm circuit 10 (FIG. 1), alarm circuit 30 has three modes of operation: 1) standby mode, 2) alarm mode, and 3) silence mode.

Alarm circuit 30 includes a control circuit 36 that comprises a clock generator 31, a counter 32, a D-type flip-flop 33, AND gates 34, 35, 37, 38, and 39, an OR gate 41, inverters 42, 43, 44, and 46, and a logic circuit 47. Flip-flop 33 has a data input terminal labeled D, a clock input terminal labeled CK, a reset input terminal labeled R, and an output terminal labeled Q. Flip-flop 33 is a latch circuit, wherein the signal at terminal Q remains at a fixed logic state until a low to high voltage transition is received at terminal CK. The voltage at terminal D is clocked to terminal Q when a low to high voltage transition occurs at terminal CK. Terminal R of flip-flop 33 is an active high input terminal. Therefore, when a logic high voltage is transmitted to terminal R of flip-flop 33, the output signal transmitted from terminal Q of flip-flop 33 is reset to a logic low voltage.

Clock generator 31 has an input terminal connected to the output terminal of oscillator 17. In addition, clock generator 31 has a first output terminal for providing a clock signal labeled CLOCK and a second output terminal for providing a clock signal labeled SAMPLE. Clock generator 31 processes the oscillator signal from oscillator 17 to generate signals CLOCK and SAMPLE. The frequency of signal SAMPLE is at least twice the frequency of signal CLOCK. In this example, signal SAMPLE has a 1% duty cycle, i.e., signal SAMPLE is at a logic high voltage for 1% of its period. Signal CLOCK has a 50% duty cycle.

The first output terminal of clock generator 31 is commonly connected to a clock input terminal of counter 32 and to a first input terminal of AND gate 34. The second output terminal of clock generator 31 is commonly connected to the first input terminals of AND gates 35, 37, and 38.

Counter 32 has a clock input terminal coupled for receiving signal CLOCK and an enable input terminal commonly connected to the second input terminal of AND gate 34 and to terminal Q of flip-flop 33. Counter 32 is enabled when a logic high voltage is transmitted to its enable input terminal from terminal Q of flip-flop 33. When enabled, counter 32 provides a logic high voltage pulse at its output terminal after a predetermined time period has elapsed or ended.

The output terminal of AND gate 34 is connected to output terminal 27 providing signal SELECT. In addition, the output terminal of AND gate 34 is commonly connected to the third input terminal of AND gate 35, the input terminal of inverter 43, and the input terminal of inverter 44. The output terminal of inverter 43 is connected to the third input terminal of AND gate 37 and the output terminal of inverter 44 is connected to the third input terminal of AND gate 38.

The output terminal of comparator 13 is commonly connected to the second input terminal of AND gate 35, the input terminal of inverter 42, and the second input terminal of AND gate 38. The output terminal of inverter 42 is connected to the second input terminal of AND gate 37.

OR gate 41 has separate input terminals connected to terminal 26, the output terminal of counter 32, the output terminal of AND gate 35, and the output terminal of AND gate 37. In addition, OR gate 41 has a another input terminal commonly connected to terminal 24 and a first input terminal of logic circuit 47. The output terminal of OR gate 41 is connected to terminal R of flip-flop 33.

Terminal D of flip-flop 33 is coupled for receiving a source of operating potential or power supply voltage such as, for example, voltage $V_{DD}$. Terminal CK of flip-flop 33 is connected to terminal 23. Terminal Q of flip-flop 33 is commonly connected to the second input terminal of AND gate 34, the enable input terminal of counter 32, and the input terminal of inverter 46. The output terminal of inverter 46 is connected to a first input terminal of AND gate 39. The output terminal of logic circuit 47 is connected to the second input terminal of AND gate 39 and the output terminal of AND gate 39 is connected to terminal 28.

The output terminals of AND gates 35 and 37 respectively provide signals labeled HIGH and LOW. The output terminal of AND gate 38 is connected to a second input terminal of logic circuit 47 for providing a signal labeled MID. Signals HIGH, LOW, and MID indicate the voltage of signal DETECT relative to the voltages of signals REF1 and REF2. For example, signal HIGH is at a logic high voltage when the voltage of signal DETECT is greater than the voltage of signal REF2. Signal LOW is at a logic high voltage when the voltage of signal DETECT is less than the voltage of signal REF1 and signal MID is at a logic high voltage when the voltage of signal DETECT is between the voltages of signals REF1 and REF2.

Logic circuit 47 together with flip-flop 33 control the voltage of signal ALARM for enabling transducer 19. Logic circuit 47 receives signals REMOTE and MID. During the alarm and silence modes of operation, if either signal REMOTE or signal MID transition to a logic high voltage, then logic circuit 47 latches a logic high voltage at its output terminal until alarm circuit 30 returns to the standby mode of operation. During the standby mode of operation, if signal REMOTE transitions to a logic high voltage, then logic circuit 47 transmits a logic high voltage to the second input terminal of AND gate 39. Otherwise, logic circuit 47 provides a logic low voltage to the second input terminal of AND gate 39.

Upon initial power up of alarm circuit 30, signals SILENCE, REMOTE, and RESET are at a logic low voltage and alarm circuit 30 operates in the standby mode of operation. Further, during initial power up, flop-flop 33 is reset so that terminal Q of flip-flop 33 provides a logic low voltage. Therefore, signal SELECT is at a logic low voltage and comparator 13 compares the voltages of signals DETECT and REF1.

If no smoke particles are detected by sensor 11, then the voltage of signal DETECT is less than the voltage of signal REF1. If the voltage of signal DETECT is less than the voltage of signal REF1, then signal COMPARE is at a logic low voltage. Because signals SELECT and COMPARE are at a logic low voltage, signals HIGH and MID are at a logic low voltage and signal LOW is at a logic high voltage after signal SAMPLE transitions to a logic high voltage. In response to signal LOW transitioning to a logic high voltage, a logic high voltage is transmitted from the output of OR gate 41 to terminal R of flip-flop 33. This resets flip-flop 33 so that the voltage of the output signal at terminal Q remains at a logic low voltage. Since both signals REMOTE and MID are at a logic low voltage, logic circuit 47 provides an output signal having a logic low voltage. This causes signal ALARM to be at a logic low voltage, thereby disabling transducer 19.

Alarm circuit 30 transitions to the alarm mode of operation after the amount of smoke detected by sensor 11 increases above a predetermined minimum threshold level. The voltage of signal REF1 corresponds to this predetermined minimum threshold level. As described hereinbefore, as the amount of smoke particles detected by sensor 11 increases, the voltage of signal DETECT increases. If signal DETECT increases to a voltage level greater than the voltage of signal REF1, signal COMPARE transitions to a logic high voltage and alarm circuit 30 enters into the alarm mode of operation.

The voltage of the output signal transmitted from terminal Q of flip-flop 33 remains at a logic low voltage since no voltage transition has occurred at terminal CK of flip-flop 33. Thus, signal SELECT remains at a logic low voltage. Because signal SELECT is at a logic low voltage and signal COMPARE is at a logic high voltage, signals HIGH and LOW are at a logic low voltage and signal MID is at a logic high voltage after signal SAMPLE transitions to a logic high voltage. In response to signal MID transitioning to a logic high voltage, a logic high voltage is transmitted from the output of logic circuit 47 to the second input of AND gate 39. This causes signal ALARM to be at a logic high voltage, thereby enabling transducer 19.

During the alarm mode of operation, if signal SILENCE is set to a logic high voltage, then alarm circuit 30 transitions to the silence mode of operation and the alarm provided by transducer 19 is inhibited. More particularly, if signal SILENCE is set to a logic high voltage, then the output signal transmitted from terminal Q of flip-flop 33 transitions to a logic high voltage. This causes signal ALARM to transition to a logic low voltage, thereby disabling transducer 19. In addition, signal SELECT toggles between a logic low voltage and a logic high voltage since signal clock is alternating between a logic low and a logic high.

Therefore, the voltage of signal DETECT is compared to the voltage of signal REF1 and to the voltage of signal REF2 during the silence mode of operation.

After signal SILENCE transitions to a logic high voltage, counter 32 is enabled so that after a predetermined time period of, for example ten minutes, the silence mode of operation is cancelled by transmitting a logic high voltage pulse from the output terminal of counter 32. This logic high voltage pulse is transmitted to terminal R of flip-flop 33 via OR gate 41 so that the output signal at terminal Q is reset to a logic low voltage, thereby enabling transducer 19.

As discussed hereinbefore, the silence mode of operation can be cancelled by one of the following events: 1) the predetermined time period elapses, 2) signal RESET is set to a logic high voltage, 3) signal REMOTE is set to a logic high voltage, 4) the voltage of signal DETECT exceeds the voltage of signal REF2, or 5) the voltage of signal DETECT decreases to a level below the voltage of signal REF1. In particular, the silence mode of operation is cancelled when any of the signals at the input terminals of OR gate 41 transition to a logic high voltage. If a logic high voltage is transmitted from the output terminal of OR gate 41 to terminal R of flip-flop 33, then the voltage of the output signal from terminal Q transitions to a logic low voltage so that the voltage of signal ALARM is a function of the voltage of the output signal from logic circuit 47.

Signals RESET and SILENCE can be controlled by switches (not shown) so that a user can put alarm circuit 30 into the silence mode by asserting signal SILENCE or cancel the silence mode by asserting signal RESET. Signal REMOTE can be controlled by a remote alarm circuit as described hereinbefore.

During the silence mode, if signal SELECT is at a logic low voltage and the voltage of signal DETECT decreases to a level less than the voltage of signal REF1, then signal LOW transitions to a logic high voltage. Control circuit 36 transitions alarm circuit 30 from the silence mode to the standby mode of operation. The voltage of the output signal from the output terminal of logic circuit 47 transitions to a logic low in response to the transition to the standby mode. Transducer 19 remains disabled since signal ALARM remains at a logic low voltage.

In addition, during the silence mode, if signal SELECT is at a logic high voltage and the voltage of signal DETECT increases to a level greater than the voltage of signal REF2, then signal HIGH transitions to a logic high voltage. Control circuit 36 transitions alarm circuit 30 from the silence mode to the alarm mode of operation. Transducer 19 is enabled since signal ALARM transitions from a logic low voltage to a logic high voltage.

By now it should be appreciated that an alarm circuit and method for controlling the alarm circuit is provided. The alarm circuit and method can be used in many different applications including smoke detectors. An advantage of the alarm circuit is that it provides a silence feature for temporarily disabling the alarm for a predetermined time period. The silence feature can be cancelled before the expiration of the predetermined time period.

What is claimed is:

1. A circuit for controlling an alarm, comprising:

a comparator having a first input coupled for receiving an input signal, a second input, and an output;

a multiplexer having a first input coupled for receiving a first reference signal, a second input coupled for receiving a second reference signal, a third input coupled for receiving a select signal, and an output coupled to the second input of the comparator; and a control circuit having an input coupled to the output of the comparator, a first output for providing the select signal, and a second output for providing a control signal for controlling the alarm.

2. The circuit of claim 1, further including a sensor coupled to the first input of the comparator for providing the input signal.

3. The circuit of claim 2, wherein the sensor is an ion sensor.

4. The circuit of claim 2, wherein the sensor is a photoelectric sensor.

5. The circuit of claim 1, further including an oscillator coupled to a second input of the control circuit.

6. The circuit of claim 1, wherein the control circuit includes a latch having an input coupled to the output of the comparator and an output coupled to the second output of the control circuit and the third input of the multiplexer.

7. The circuit of claim 6, wherein the control circuit further includes a counter having an output coupled to the input of the latch.

8. The circuit of claim 7, wherein the latch is a flip-flop having a reset input coupled to the output of the comparator, a data input coupled for receiving a power supply voltage, a clock input coupled to a second input of the control circuit, and an output coupled to the second output of the control circuit.

9. The alarm circuit of claim 8, wherein the control circuit further includes:

a first AND gate having a first input coupled to the output of the comparator and an output;

a second AND gate having a first input coupled to the output of the comparator and an output;

a third AND gate having a first input coupled to the output of the comparator and an output coupled to the second output of the control circuit; and an OR gate having a first input coupled to the output of the first AND gate, a second input coupled to the output of the second AND gate, a third input coupled to the output of the counter, and an output coupled to the reset input of the flip-flop.

10. The circuit of claim 9, wherein the control circuit further includes a fourth AND gate coupled between the output of the latch and the third input of the multiplexer, wherein the fourth AND gate has a first input terminal coupled for receiving a clock signal, a second input terminal coupled to the output of the output of the flip-flop, and an output commonly coupled to the third input of the multiplexer, a second input of the first AND gate, a second input of the second AND gate, and a second input of the third AND gate.

11. The circuit of claim 1, wherein the control circuit is a microprocessor that enables the alarm when a magnitude of the input signal is greater than a magnitude of the first reference signal, disables the alarm when the magnitude of the input signal is less than the magnitude of the first reference signal, and enables the alarm when a magnitude of the input signal is greater than a magnitude of the second reference signal.

12. A method for controlling an alarm, comprising the steps of:

operating in an alarm mode of operation after an input signal exceeds a first threshold level, wherein the alarm is enabled during the alarm mode;

operating in a silence mode of operation after a silence signal is received, wherein the alarm is disabled during the alarm mode; and comparing the input signal to the first threshold level during the silence mode of operation.

13. The method of claim 12, further including the step of comparing the input signal to a second threshold level during the silence mode.

14. The method of claim 13, further including the step of transitioning from the silence mode to the alarm mode after the input signal exceeds the second threshold level.

15. The method of claim 12, further including the step of transitioning from the silence mode to a standby mode of operation after the input signal decreases below the first threshold level, wherein the alarm is disabled during the standby mode.

16. The method of claim 12, wherein the step of operating in the silence mode includes disabling the alarm for a predetermined time period during the silence mode.

17. The method of claim 16, further including the step of terminating the silence mode before the predetermined time period ends.

18. The method of claim 12, further including the step of terminating the silence mode after receiving a reset signal.

19. The method of claim 12, further including the step of terminating the silence mode after receiving a remote signal from another alarm.

20. A method for controlling an alarm, comprising the steps of:

enabling the alarm after a magnitude of an input signal increases to a level above a first threshold level;

disabling the alarm after receiving a silence signal; and comparing the magnitude of the input signal to the first threshold level after receiving the silence signal.

21. The method of claim 20, further including the step of comparing the magnitude of the input signal to a second threshold level after receiving the silence signal.

* * * * *